US011918846B2

(12) United States Patent
Murray

(10) Patent No.: US 11,918,846 B2
(45) Date of Patent: Mar. 5, 2024

(54) TREADMILL EXERCISE APPARATUS

(71) Applicant: REMEDY INNOVATIONS LTD, Greater London (GB)

(72) Inventor: Frederick Murray, Kingston (GB)

(73) Assignee: REMEDY INNOVATIONS LTD (GB)

( * ) Notice: Subject to any disclaimer, the term of this patent is extended or adjusted under 35 U.S.C. 154(b) by 207 days.

(21) Appl. No.: 17/311,488

(22) PCT Filed: Dec. 3, 2019

(86) PCT No.: PCT/GB2019/053415

§ 371 (c)(1),
(2) Date: Jun. 7, 2021

(87) PCT Pub. No.: WO2020/115470

PCT Pub. Date: Jun. 11, 2020

(65) Prior Publication Data

US 2022/0016474 A1 Jan. 20, 2022

(30) Foreign Application Priority Data

Dec. 7, 2018 (GB) ..... 1819966

(51) Int. Cl.
*A63B 22/02* (2006.01)
*A63B 21/00* (2006.01)
*A63B 69/00* (2006.01)

(52) U.S. Cl.
CPC ..... *A63B 22/02* (2013.01); *A63B 21/4035* (2015.10); *A63B 69/0057* (2013.01); *A63B 2208/0204* (2013.01)

(58) Field of Classification Search
CPC ..... A63B 21/4027; A63B 21/4033; A63B 21/4034; A63B 21/4035; A63B 21/4039;
(Continued)

(56) References Cited

U.S. PATENT DOCUMENTS 5,085,426 A * 2/1992 Wanzer ..... A63B 22/02 482/54
5,088,729 A * 2/1992 Dalebout ..... A63B 22/025 482/54

(Continued)

FOREIGN PATENT DOCUMENTS

CN 103537063 B * 11/2015
CN 205127276 4/2016

(Continued)

OTHER PUBLICATIONS

European Search Report for European Application No. GB1819966.1 dated Apr. 25, 2019.

(Continued)

*Primary Examiner* — Gary D Urbiel Goldner
(74) *Attorney, Agent, or Firm* — The Belles Group, P.C.

(57) ABSTRACT

An exercise apparatus includes a treadmill mounted on a frame with a rotating conveyor providing a moving surface for a person to exercise upon. The exercise apparatus also includes at least three static foot support portions connected to the frame allowing the person to stand on the exercise apparatus and not on the moving surface. First and second static foot support portions of the at least three static foot support portions are on either side of the rotating conveyor, and a third static foot support portion of the at least three static foot support portions is located in front of the moving surface approximately below a grasping handle.

2 Claims, 3 Drawing Sheets

(58) Field of Classification Search
CPC ..... A63B 22/0046; A63B 22/02; A63B 26/00; A63B 26/003; A63B 69/0028; A63B 69/0057; A63B 2069/0037; A63B 71/0009; A63B 71/0054; A63B 2071/0072; A63B 2071/0081; A63B 2071/009; A63B 2208/0204; A63B 2208/0209
See application file for complete search history.

(56) References Cited

U.S. PATENT DOCUMENTS

| | | | | | |
|---|---|---|---|---|---|
| 5,163,885 | A * | 11/1992 | Wanzer | A63B 22/02 | 482/54 |
| 5,171,196 | A | 12/1992 | Lynch | | |
| 5,279,528 | A | 1/1994 | Dalebout | | |
| 5,595,556 | A * | 1/1997 | Dalebout | A63B 21/00069 | 482/54 |
| 5,660,550 | A * | 8/1997 | Roche | A63B 22/02 | 473/427 |
| 6,350,218 | B1 | 2/2002 | Dalebout | | |
| 6,520,891 | B1 * | 2/2003 | Stephens, Jr. | A63B 23/047 | 482/121 |
| 2001/0016543 | A1 * | 8/2001 | Dalebout | A63B 22/02 | 482/57 |
| 2002/0045518 | A1 * | 4/2002 | Dalebout | A63B 22/02 | 482/51 |
| 2002/0151413 | A1 * | 10/2002 | Dalebout | A63B 22/02 | 482/54 |
| 2003/0153434 | A1 * | 8/2003 | Dalebout | A63B 22/02 | 482/54 |
| 2004/0192514 | A1 * | 9/2004 | Piaget | A63B 22/0664 | 482/52 |
| 2004/0248699 | A1 | 12/2004 | Colley | | |
| 2005/0233864 | A1 * | 10/2005 | Smith | A63B 22/02 | 482/52 |
| 2005/0277520 | A1 * | 12/2005 | Van Waes | A63B 71/04 | 482/54 |
| 2016/0096064 | A1 * | 4/2016 | Gatti | A63B 69/0057 | 482/54 |
| 2016/0158622 | A1 * | 6/2016 | Yamazaki | A63B 24/0087 | 482/7 |
| 2016/0263426 | A1 * | 9/2016 | Mueller | A63B 22/001 | |
| 2017/0056712 | A1 * | 3/2017 | Johnson | A63B 21/4035 | |
| 2017/0056716 | A1 * | 3/2017 | Cutler | A63B 22/0285 | |
| 2017/0056726 | A1 * | 3/2017 | Dalebout | A63B 22/0235 | |
| 2017/0266483 | A1 * | 9/2017 | Dalebout | A63B 24/0087 | |
| 2017/0266534 | A1 | 9/2017 | Watterson | | |
| 2018/0272178 | A1 * | 9/2018 | Kennedy | A63B 22/02 | |
| 2019/0217142 | A1 * | 7/2019 | Hsu | A63B 22/02 | |

FOREIGN PATENT DOCUMENTS

| | | | | |
|---|---|---|---|---|
| CN | 107899183 | | 4/2018 | |
| CN | 107899183 | A | 4/2018 | |
| CN | 105392461 | B * | 6/2018 | A61H 1/0255 |
| CN | 108744398 | | 11/2018 | |
| CN | 108744398 | A | 11/2018 | |
| EP | 2789371 | | 10/2014 | |
| JP | H11512953 | A * | 11/1999 | A61H 1/0255 |
| KR | 200325879 | Y1 * | 9/2003 | A63B 22/02 |
| KR | 20150057454 | A * | 5/2015 | A63B 22/02 |
| KR | 102296449 | B1 * | 9/2021 | A63B 21/4035 |
| WO | WO-9733656 | A1 * | 9/1997 | A63B 21/4035 |

OTHER PUBLICATIONS

European Search Report for European Application No. GB2106519.8 dated Jun. 17, 2021.

* cited by examiner

TREADMILL EXERCISE APPARATUS

CROSS-REFERENCE TO RELATED PATENT APPLICATIONS

The present application is a U.S. national stage application under 35 U.S.C. § 371 of PCT Application No. PCT/GB2019/053415, filed Dec. 3, 2019, which claims priority to United Kingdom Patent Application No. 1819966.1, filed Dec. 7, 2018. The disclosures of the aforementioned priority applications are incorporated herein by reference in their entireties.

The present invention relates to a device for assisting a person to exercise and relates particularly, but not exclusively, to a treadmill for use in physiotherapy and rehabilitation.

The use of treadmills as an apparatus for helping person to exercise is well-known and they are commonplace in gyms. They are also commonly used in physiotherapy and for rehabilitation exercise as they can be precisely controlled to ensure that the right level of exercise is being undertaken by a patient or person in rehabilitation. In addition to the standard running and walking exercises undertaken on a treadmill, it is known for treadmills to be adapted to allow a user to exercise using a scooting action, that is the action associated with powering a stand on manual scooter where a scooter rider stand with 1 foot on a platform and uses the other leg to push on the ground to move the scooter forward.

An example of a treadmill which has been adapted to allow the user to undertake a scooting action is disclosed in European patent published under the number EP 278 9371. The device disclosed therein provides an apparatus to adapt an existing treadmill to allow a user to undertake the scooting action previously described. However, the adaptation of the device is cumbersome thereby requiring significant effort on the part of the user to switch from one mode of use to another. Another problem associated with treadmills is that running on a treadmill provides a single form of exercise which can prove to be very monotonous. There is therefore a need to allow a person using a single piece of exercise apparatus to vary the exercise they are undertaking. This not only improves the exercise by varying the muscle groups being used but maintains the user's mental interest in undertaking the exercise.

Preferred embodiments of the present invention seek to overcome or alleviate the above described disadvantages of the prior art.

According to the present invention there is provided an exercise apparatus, comprising:

a frame;

a treadmill mounted on said frame including a rotating conveyor providing a moving surface for supporting a person thereon during exercise said moving surface defining a direction of travel;

a plurality of static foot support portions connected to said frame allowing said person to stand on said apparatus and not on said surface, said foot support portions including a first said support portion located on one side of said conveyor with respect to said direction of travel, a second said foot support portion on another side of said conveyor opposite said first foot support portion and a third said foot support portion located in front or behind said moving surface with respect to said direction of travel.

By providing a treadmill with three static foot support portions with one of those being located in the direction of travel of the conveyor, that is either in front or behind the conveyor, the advantage is provided that the treadmill can be used for both running and scooting action exercises with the leg operating in the parasagittal plane running or using the first and second foot support portions but can also undertake a sideways scooting action using the third foot support portion therefore exercising in the frontal plane and in particular doing so in a lateral scooting type action. This provides physiotherapeutic advantages by operating and working different muscle groups. When undertaking the scooting exercise in the frontal plane users are exposed biomechanically to a 3-dimensional workout so as to counteract the axis of rotation on the body they must recruit the muscles of the sagittal, frontal and transverse planes. It also maintains a user's mental interest in the exercise whilst using a single piece of apparatus allowing an exercise routine to include the standard treadmill exercises of walking jogging and sprinting and adding to that scooting in the parasagittal plane separately using the left and right legs as the standing leg and then scooting whilst standing on the third foot support portion thereby working the other leg in the frontal plane.

The apparatus may further comprise at least one handle providing a plurality of grasping portions wherein a first pair of said grasping portions are aligned perpendicular to said direction of travel and a second pair of grasping portions aligned parallel to said direction of travel and wherein said first grasping portions are located behind said second grasping portions with respect to said direction of travel.

The above arrangement of gripping portions ensures that a suitable stabilising handgrip is provided at an appropriate location to enable the previously described exercises to be undertaken without the handles interfering with other exercises, for example standard running on a treadmill.

In a preferred embodiment at least one of first grasping portions and one of said second grasping portions are together formed in an L shape and the other of said first and second grasping portions together form an L shape.

By arranging the gripping portions into an L shape and fixing them to the frame so as to divide the gripping portions into pairs of handgrips the advantage is provided that a very stable connection between each handgrip and the frame can be provided whilst keeping the grasping portions at a suitable size and sufficiently small not to interfere with other exercises such as a standard treadmill running. The L shape handle can also be used to jump on and off the treadmill when in the running/sprinting mode of operation.

In another preferred embodiment the third step foot support portion is located in front of said conveyor with respect to said direction of travel.

In an alternative embodiment the third foot support portion is located behind said conveyor with respect to said direction of travel.

In a further preferred embodiment at least one the foot support portion is at a height which is higher than an adjacent portion of said moving surface.

By placing the foot support portion and a height which is higher than the adjacent portion of the moving surface of the conveyor the advantages provided that the user is forced to work both legs when undertaking the scooting action. If the right leg is the standing leg then the left leg is undertaking the scooting action as previously described but the first leg must also bend into a slight squatting/flexed position in order to ensure that the left foot engages the conveyor surface. This action works a different group of muscles from the scooting action and therefore provides two very different exercises at the same time. This not only assists in maintaining interest in an exercise regime as users can use the standing or moving leg easily or very hard making the exercise experience very flexible. It is also useful from a physiotherapy to point of view in maintaining work in one leg whilst reducing the work in the other or working different muscle groups appropriate to an injury under rehabilitation.

In a preferred embodiment the first, second and third foot support portions are at a height which is higher than their respective adjacent portions of said moving surface.

In another preferred embodiment at least one foot support portion comprises a gripping material.

Preferred embodiments of the present invention will now be described, by way of example only, and not in any limitative sense with reference to the accompanying drawings in which.

Figure 1:
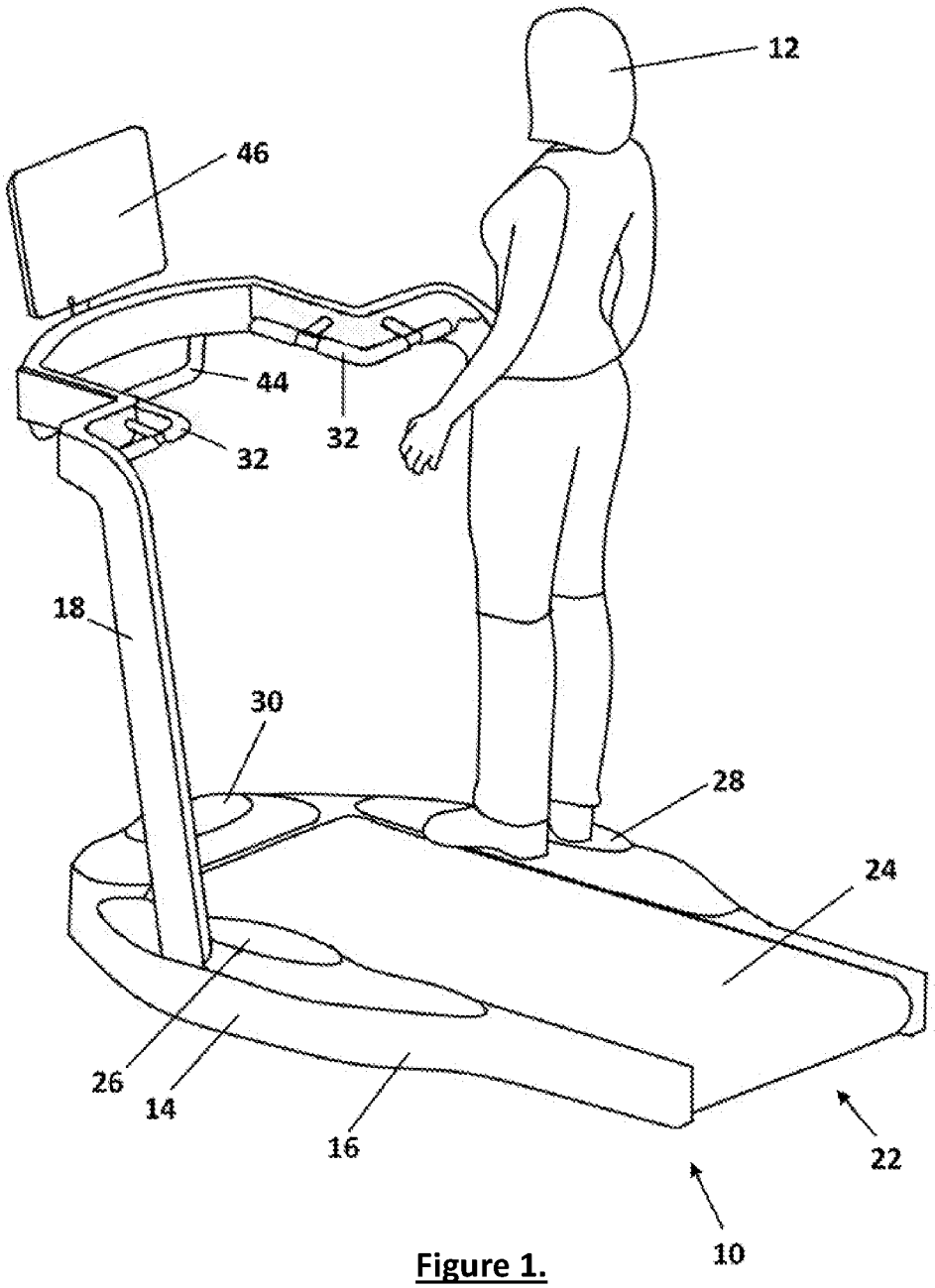
FIG. 1 is a perspective view of an exercise apparatus of the present invention.
Figure 2:
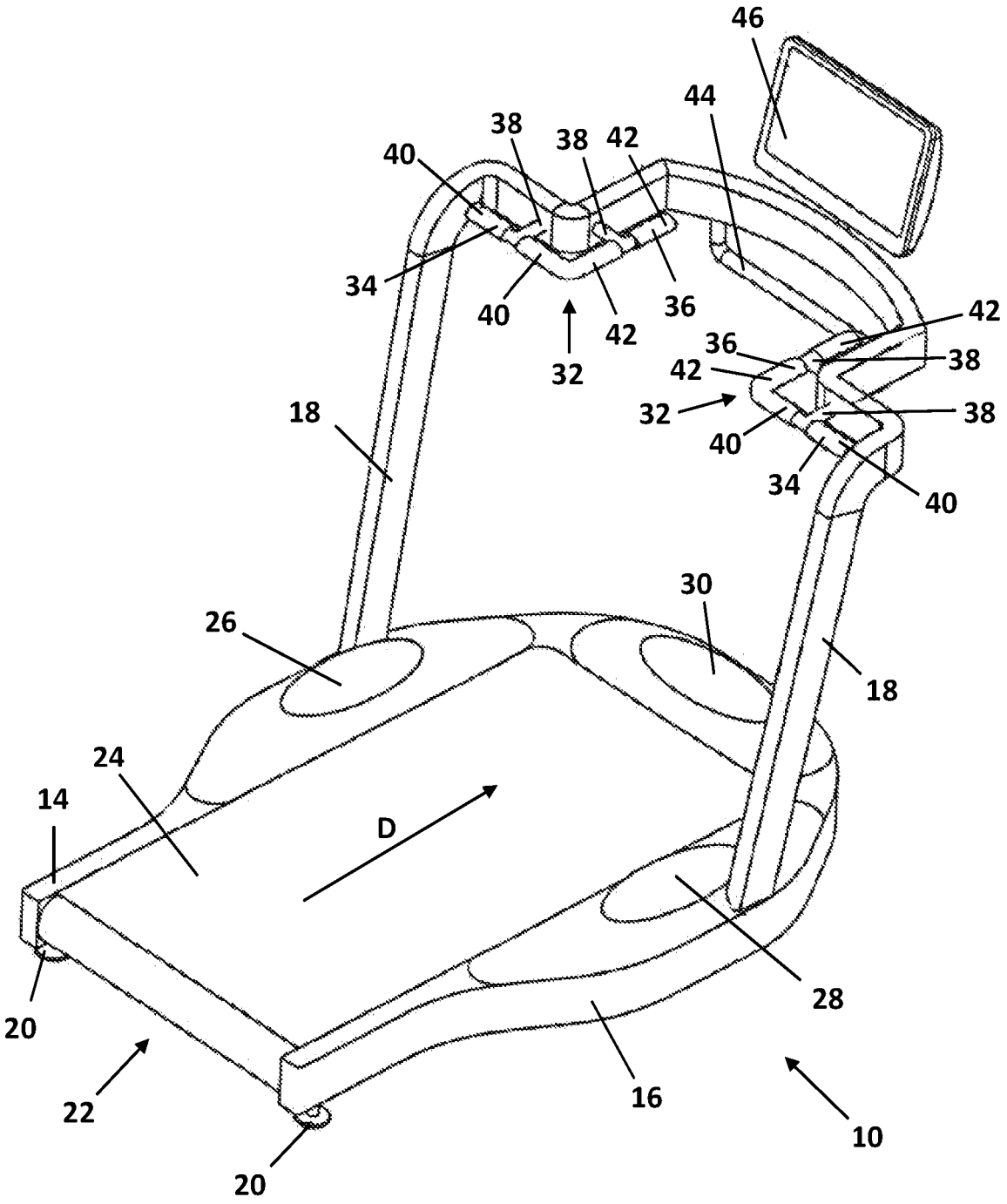
FIG. 2 is a perspective view, from another angle, of the apparatus of FIG. 1.

Referring to all of the figures, an exercise apparatus 10, commonly referred to as a treadmill or running machine, is used by a person 12 wishing to exercise allowing them to undertake a running, jogging or walking type exercises, amongst others, without the need for a large open space.

The apparatus 10 includes a frame 14 which has a base 16 and a frame upright 18 extending from the base. Feet 20 are also provided to engage the floor surface and the distance which these feet extend from the base 16 can be adjusted in order to ensure that the apparatus 10 is sitting flat on the floor. Mounted on the base portion 16 of the frame 14 is a treadmill which includes a rotating conveyor which provides a moving surface on which a person exercising can stand. The conveyor 22 includes a belt 24 which is mounted on a pair of rollers (not shown) which are attached to the frame. At least one of the rollers is motorised causing it to rotate which in turn moves the belt to create the moving surface and thereby defining a direction of travel D. The direction of travel D is defined with respect to a person using the apparatus 10 and is the direction that person would be moving if they were walking or running on the treadmill. In other words, the direction of travel D is the opposite direction to the direction in which the belt 24 is moving.

Mounted to the base portion 16 of frame 14 are three static foot support portions which allow the person to stand on the apparatus without standing on the moving conveyor. The static foot portions include a first foot support portion 26 which is located on the left-hand side of the belt 24 with respect to the direction of travel D, a second support portion 28 is provided on the right-hand side of the belt and a third foot support portion 30 is provided in front of the belt 26 with respect to the direction of travel D. The foot support portions are elliptical in shape and are formed with a foot engaging portion made from a roughened gripping material. The major axis of the ellipses of the first and second foot support portions have a major axis parallel to the direction of travel D where the major axis of the ellipse of the third support portion is perpendicular to the direction of travel D.

In the example shown in FIG. 1, the person 12 who is exercising on the apparatus 10 is standing on the second foot support portion 28 with their right leg and as a result, there leg is positioned above the belt 24. When power is supplied to the motorising device and the belt 24 is rotating the person 12 is able to perform a scooting-type action on the treadmill with their left foot whilst their right foot remains static. The left foot action is movement in a plane which is parallel to the direction of travel D, that is the exercise is undertaken with the person standing so that their sagittal plane is parallel to the direction of travel D. The same action can be performed using the other leg by standing with the left foot static on first support portion 26 and the right leg performing the scooting action.

So as to accurately mimic the scooting action the first and second foot support portions 26 and 28 are raised up at a height higher than the height of the surface of the belt 24 this produces the same action as when scooting the platform on which a person stands is above the height of the ground. Ideally, the platforms are 50 mm +/−5 mm above the surface of the belt. As a result, the scooting exercise works both legs differently. For example, when a person is standing on the second foot support portion 28, as shown in FIG. 1, the left leg swings in a parasagittal plane contacting the belt 24 and performing a pushing action as though the person was riding a scooter. The forward swing phase of this action is a non-weight bearing dynamic movement working the truck flexors isometrically, the hip flexors concentrically and the ankle dorsi flexors isometrically to gain the clearance from the floor of the treadmill. During the backward swing phase of the moving leg the trunk extensors work isometrically, the hip extensors, knee flexors and the ankle plantar flexors work concentrically. At the same time the right leg, which is the weight bearing leg, is bending/flexing slightly producing a squatting action. In order to build the momentum to swing the moving leg through at a good speed the user has the use the trunk extensors isometrically and the hip, knee and ankle planter flexors eccentrically to lower the left leg so that it can engage the belt 24.

A set out above, the major axis of the third foot support portion 30 is perpendicular to the major axes of the first and second foot support portions. This arrangement allows the person 12 to stand on the third foot support portion 30 with their sagittal plane perpendicular to the direction of travel D. As a result, in order to exercise when stood on the third support portion the non-standing leg is placed onto the belt 24 and pushes against the belt sideways thereby exercising that leg in the frontal plane. This action can be performed on either leg by the person simply rotating themselves through 180°. To ensure the standing leg must perform the shallow squatting movement described above, the third foot support portion 30 is also raised above the height of the belt 24.

Another exercise using the third foot support portion 30 is to undertake a pull and push exercise by first sliding the moving leg out (this is a hip abduction movement) on the belt which recruits the opposite trunk side flexors and extensors isometrically, the hip abductors, knee extensors, ankle plantar flexors and evertors concentrically. The second part of the movement is to pull the treadmill back into themselves (hip adduction movement) which recruits the opposite trunk flexors and rotators isometrically and the hip adductors and ankle invertors concentrically.

Alternatively, or in addition, and not shown in the drawings, a fourth foot support portion could be located at the back of the rotating conveyor 22 so as to provide a scooting type action, again in the frontal plane, but this time moving the non-standing leg towards the standing leg.

Figure 3:
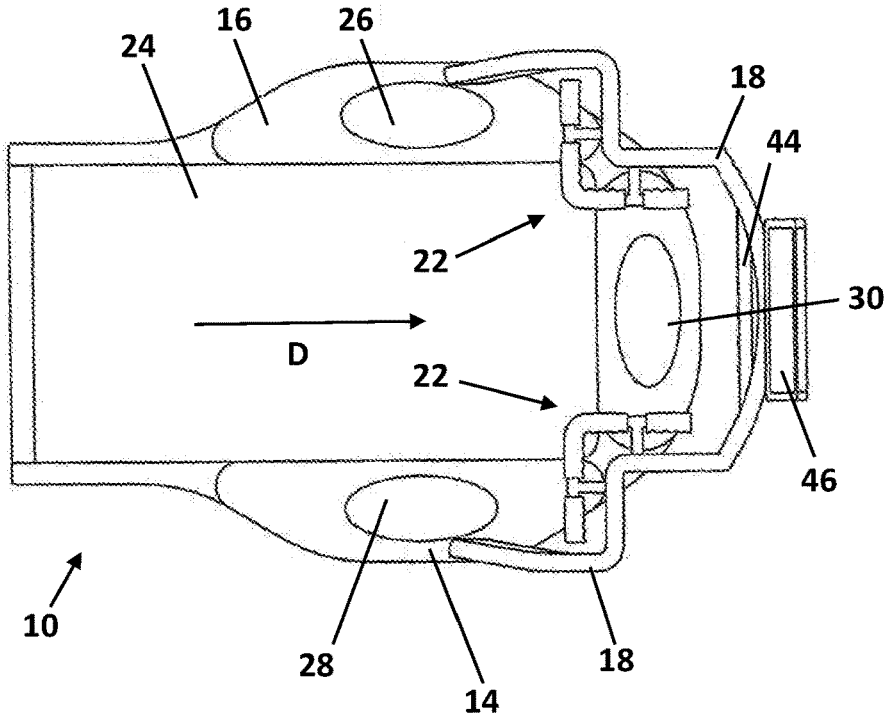
FIG. 3 is a plan view of the apparatus of FIG. 1.
Figure 4:
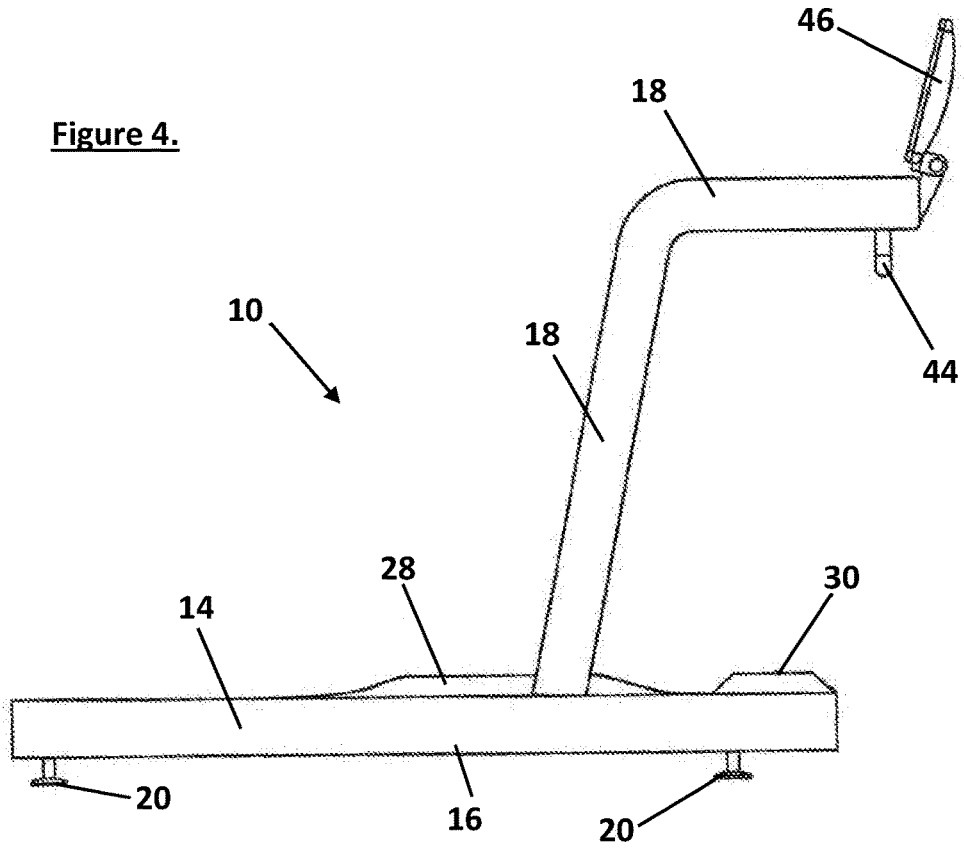
FIG. 4 is a side view of the apparatus of FIG. 1.

A pair of handles 32 are provided and attached to the frame upright 18. These handles 32 are to assist the person 12 when undertaking the scooting-type exercises previously described. Each handle 32 is divided into first and second grasping portions 34 and 36 with the first grasping portions 34 being arranged perpendicular to the direction of travel D and the second grasping portions 36 being arranged parallel to the direction of travel D. The arrangement of the first and second grasping portions 34 and 36 is such that first grasping portions are behind the second grasping portions with respect to the direction of travel D. As can be seen in FIG. 3, the handles 32 are L shaped and are attached to the frame upright 18 by stem portions 38. These stem portions thereby divide each grasping portion, 34 and 36, into a pair of handgrips 40 (with respect to the first grasping portions) and 42 (with respect to the second grasping portions).

These handgrips can be held by a person who is undertaking the scooting action in order to help to stabilise themselves and form an arrangement similar to the handlebars of a scooter. Specifically, when a person is scooting whilst standing on the first foot support portion 26 they grasp the handgrips 40 on the left-hand side of the exercise apparatus and when scooting and standing on the second foot support portion 28 they use the handgrips 40 on the right-hand side of the apparatus. When performing the frontal plane scooting action and standing on the third foot support portion 30 they use either the pair of hand grips 42 on the left-hand side or the right-hand side of the apparatus depending on which way round the standing.

Also extending from the frame upright 18 is a front-most hand support bar 44 located at a height lower than the handles 32. This hand support bar 44 allows the person 12 to undertake a hill walking movement by leaning forward with straight arms users use their core and upper body muscles to hold that position whilst they perform a hill walking technique. By holding onto the bar 44 with their arms extended and their back straight whilst attempting to make their spine substantially parallel to the floor. Located above the hand support bar 44, and attached to the frame upright, is a controller in the form of a touchscreen 46 with an associate processor which controls the speed of the rotation of the roller thereby controlling the speed of the belt.

As can be seen from the above description, the apparatus allows a variety of exercises to be undertaken on the one apparatus. Below in table 1 is an example of a 30 minute workout routine which can completed on the apparatus 10 allowing the person 12 to undertake several exercises thereby maintaining their interest in the exercise without having to move from one apparatus to another.

TABLE 1

| | |
|---|---|
| 1 | 2 min walk |
| 2 | 5 min jog |
| 3 | 1 min scoot left leg (sagittal plane) |
| 4 | 1 min scoot right leg (sagittal plane) |
| 5 | 1 min scoot left leg (frontal plane) |
| 6 | 1 min scoot right leg (total 5 mins with change overs) |
| 7 | 30 sec interval sprint + 30 sec rest × 5 (total 5 mins) |
| 8 | 1 min scoot left leg (sagittal plane) |
| 9 | 1 min scoot right leg (sagittal plane) |
| 10 | 1 min scoot left leg (frontal plane) |

TABLE 1-continued

| | |
|---|---|
| 11 | 1 min scoot right leg (total 5 mins with change overs) |
| 12 | 30 sec interval sprint – 30 sec rest × 5 (total 5 mins) |
| 13 | Cooldown walk with arms outstretched on front bar (3 mins) |
| | Total: 30 mins |

It will be appreciated by persons skilled in the art that the above embodiments have been described by way of example only and not in any limitative sense, and that various alterations and modifications are possible without departure from the scope of the protection which is defined by the appended claims. For example, the height of the first, second and third foot support portions 26, 28 and 30 can be made variable increase or decrease the difficulty of the exercise on the standing leg. This can be achieved through a variety of methods including the addition of blocks which fix to the foot support portions or into recesses formed in the foot support portions. In addition, the height of the handles 32 can be variable to accommodate different heights of users or to rebalance the height of the bars with respect to the foot support portion. This can be achieved by varying the height of the handles 32 with respect to the frame upright 18 or the height of the frame upright with respect the remainder of the frame base 16.

The invention claimed is:

1. An exercise apparatus, comprising:

a frame;

a treadmill mounted on said frame and including a rotating conveyor providing a moving surface, for supporting a person thereon during exercise, said moving surface defining a direction of travel; and a plurality of static foot support portions connected to said frame allowing said person to stand on said frame and not on said moving surface, said plurality of static foot support portions being respectively elevated above an upper planar surface of the frame and including a first static foot support portion located on one side of said rotating conveyor with respect to said direction of travel, a second static foot support portion on another side of said rotating conveyor opposite said first static foot support portion and a third static foot support portion located in front or behind said moving surface with respect to said direction of travel, wherein said third static foot support portion is at a height which is higher than adjacent portions, respectively, of said moving surface.

2. The exercise apparatus according to claim 1, wherein said first, second and third static foot support portions are at the height which is higher than adjacent portions, respectively, of said moving surface.

* * * * *